United States Patent [19]

Weaver et al.

[11] Patent Number: 5,072,981

[45] Date of Patent: Dec. 17, 1991

[54] SOIL MOISTURE TUBE EXTRACTION DEVICE

[75] Inventors: Barry A. Weaver; Douglas E. Whitt, both of Laporte, Colo.

[73] Assignees: The United States of America, as represented by the Secretary of Agriculture, Washington, D.C.; Colorado State University Research Foundation, Fort Collins, Colo.

[21] Appl. No.: 603,505

[22] Filed: Oct. 26, 1990

[51] Int. Cl.[5] ..... B66C 1/44

[52] U.S. Cl. ..... 294/102.1

[58] Field of Search ..... 294/86.3, 86.31, 90, 294/96, 102.1, 102.2, 114; 24/115 M, 136 R,B; 175/255; 188/65.1, 65.2, 67; 403/347-370, 374

[56] References Cited

U.S. PATENT DOCUMENTS

| | | | |
|---|---|---|---|
| 1,365,357 | 1/1921 | Twiss | 294/102.1 X |
| 1,601,369 | 9/1926 | Montgomery | 294/102.2 |
| 1,660,708 | 2/1928 | Grant | 294/102.2 |
| 1,785,644 | 12/1930 | O'Bannon | 294/86.31 |
| 2,699,589 | 1/1955 | Redell | 294/102.1 |
| 2,781,222 | 2/1957 | Smith | 294/86.3 |
| 3,534,996 | 10/1970 | De Witt | 294/102.1 |
| 3,675,278 | 7/1972 | Powell | 294/102.2 |

FOREIGN PATENT DOCUMENTS

| | | | |
|---|---|---|---|
| 2250881 | 4/1974 | Fed. Rep. of Germany | 294/102.1 |

*Primary Examiner*—Johnny D. Cherry

*Attorney, Agent, or Firm*—M. Howard Silverstein; John D. Fado; Curtis P. Ribando

[57] ABSTRACT

A versatile device is provided for securely gripping the outer surface of a cylindrical object and pulling it against a resistant force comprising a sleeve that fits around the cylindrical object and engages its outer surface with gripping jaws when a pulling force is applied. The extractor enables efficient and economical extraction of soil access tubes without tube damage. The device can be operated either with large power equipment or with a manual jack.

2 Claims, 1 Drawing Sheet

SOIL MOISTURE TUBE EXTRACTION DEVICE

BACKGROUND OF THE INVENTION

1. Field of the Invention

A number of operations require the temporary installation of access tubes in the soil. For example, the determination of soil water by neutron probe requires that the probe be lowered into soil to various depths within an access tube. Similarly, dewatering wells for excavation sites and hydrologic exploration wells require the installation of tubes that are intended to be extracted later. This invention relates to a versatile device for efficiently and economically extracting soil access tubes while leaving them undamaged and suitable for reuse.

2. Description of the Prior Art

A popular method for making repeated measurements of water in soil involves the use of a neutron probe. The technique is based on the characteristic of small atoms (primarily hydrogen in soils) to deflect and significantly reduce the speed of fast-moving neutrons [Brady, In The Nature and Property of Soils, N. C. Brady (ed.), Macmillan Publishing Co., NY, pp. 164–199 (1974); Hauser, Trans. of the ASAE 27: 722–728 (1984)]. A fast-neutron sealed source (americium-beryllium is commonly used) is contained in the neutron access "probe". For measurement of soil water content, the probe is lowered into the soil profile to various depths within a neutron probe access tube. The soil water content is determined by measuring the relative number of deflected, thermal neutrons that return to the probe as a result of bombardment of the soil by the fast neutrons. The thermal neutron detector is also contained within the probe. The number of deflected neutrons is proportional to soil water content. These devices work best in mineral soils where the vast majority of hydrogen atoms are contained in water molecules.

One of the most important technical considerations for obtaining good readings from neutron probes is correct installation of the access tubes. For best readings, the tubes should fit snugly into the profile where soil cores have been removed. Large air spaces between the access tube and the surrounding soil can cause errors in soil water measurement (Hauser, supra). Removal of correctly installed access tubes, which often are up to 2 m or more in length, can be extremely difficult, especially if the tubes have been in a clay-rich soil for an extended period. Therefore, labor and material costs associated with extracting neutron access tubes can be substantial, especially in heavy soils or with less experienced operators, where tube damage can reach 100% and replacement cost becomes significant.

Several implements for extracting tubes are available, but none are completely satisfactory. One type of extraction device attaches to access tubes by exerting force on the inside of the tube. Such devices can damage access tubes in heavy soils. Furthermore, they cannot be repositioned lower inside tubes during their removal. Thus, such devices have limited capability to extract long tubes with a manual jack, and the result is an awkward and time-consuming operation.

SUMMARY OF THE INVENTION

We have now invented a device for securely gripping the outer surface of a cylindrical object and pulling the object against a resistant force, which is especially effective in extracting soil access tubes while leaving them undamaged and suitable for reuse. The gripping device comprises a sleeve adapted to loosely fit around the cylindrical object and to bring gripping jaws into contact with the outer surface of the cylindrical object when a pulling force is applied.

In accordance with this discovery, it is the objective of this invention to provide an inexpensive device for efficiently and economically extracting soil access tubes at a lower labor cost than is possible with contemporary implements.

In addition, other objectives of this invention are to provide a tube-extractor device that 1) avoids the tube damage frequently encountered with contemporary implements, in particular those that exert force on the inside of the tube, 2) can be easily repositioned lower on the tube to facilitate the extraction of long tubes with a manual jack, 3) is applicable to both metal and plastic tubes, 4) has a potentially long useful life because of its simple yet sturdy design, and 5) can be operated either with large power equipment in easily accessible locations or with a manual jack in more confined or remote environments.

Other objects and advantages of this invention will become readily apparent from the ensuing description.

BRIEF DESCRIPTION OF THE DRAWINGS

FIG. 1 is a top view of the assembled tube extractor.

FIG. 2 is a cross-sectional view of the assembled tube extractor.

FIG. 3 is a side view of the assembled tube extractor.

DETAILED DESCRIPTION OF THE INVENTION

Figure 1:
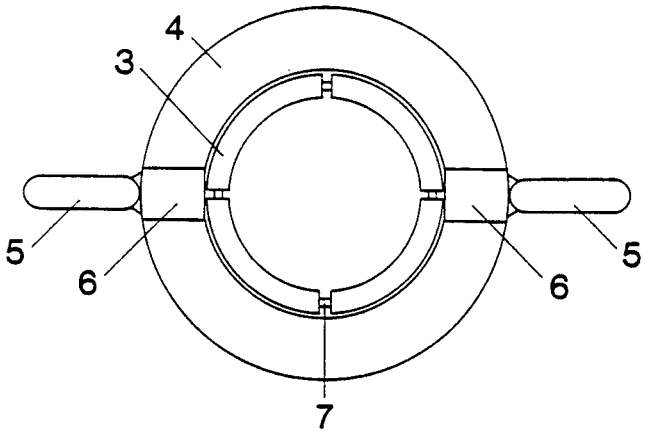
FIGS. 1–3 illustrate a preferred embodiment of the invention.
Figure 2:
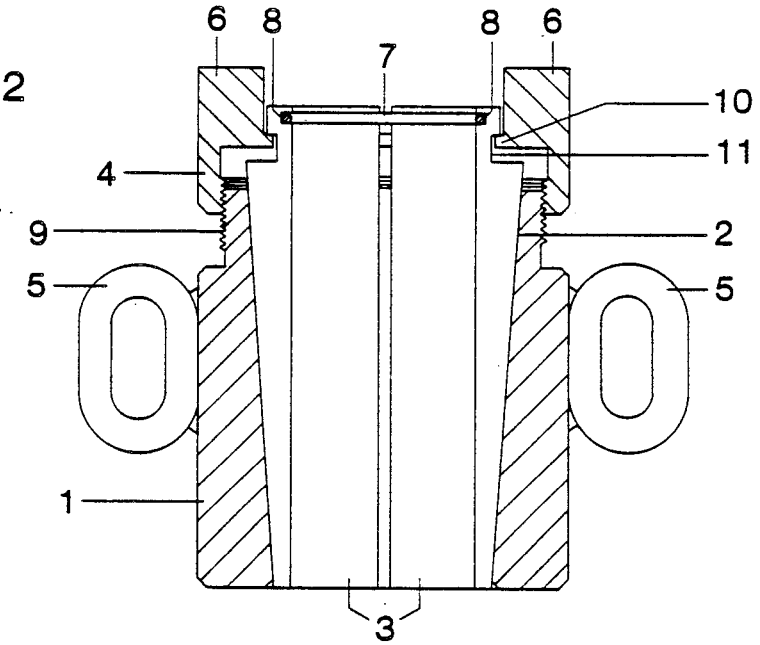
Figure 3:
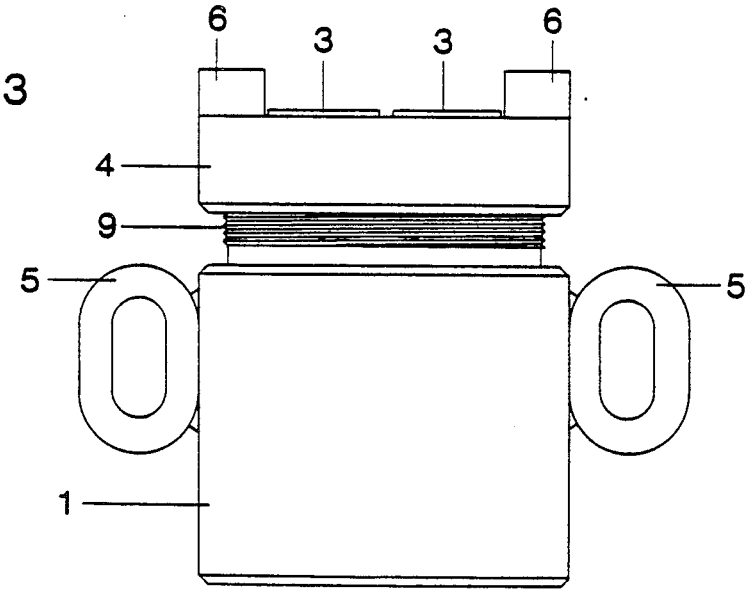

Referring to the drawings, the main body of the tube extractor of this invention comprises an outer sleeve 1 having a tapered, frustum-shaped bore which forms inner surface 2. The end of the sleeve, corresponding to the wide end of the bore, is provided with external threads 9. The exterior of sleeve 1 is equipped with a pair of rings 5, or the like, for applying a pulling force to the device.

Adapted to mate with the inner surface 2 of sleeve 1 are two or more externally tapered clamping jaws 3. Inner surface 2 and the outer surfaces of jaws 3 should be substantially smooth to permit the respective components to engage one another as they slide together, described further below. The interior surfaces of the jaws are shaped and sized to correspond to the exterior surface of the cylindrical object to be gripped.

The jaws are spaced apart about the interior of sleeve 1 and loosely held in position by means of collar 4. The collar is internally threaded to mate with the threads 9 of sleeve 1. The collar is also preferably provided with lugs 6 to facilitate tightening of the mating threads with a wrench.

In a preferred embodiment of the invention, four jaws, each of which are dimensioned to grip slightly less than 90° of the circumference of the cylindrical object, are employed. Collectively, the jaws contact a major portion of the outer surface of the cylindrical object surrounded by the sleeve. The collar 4 is equipped with an interior lip 10 for engaging a groove 11 in the broad end of the jaws. An internal snap ring 7 engages groove 8 in the jaws and secures them against the inner bore of the collar. The collar and jaws can thereby be handled as a complete assembly. Extractor components may be fabricated of carbon steel or any other rigid material having the strength required for the intended application.

The collar 4 and jaws 3 constitute an assembly which is held together by snap ring 7. Prior to use, the collar is attached loosely to the sleeve 1 by means of mating threads 9. In preparation for extracting a tube from the soil, the extraction device is positioned loosely around the tube, and tightened sufficiently via mating threads 9 to hold the extractor in place on the tube until the extraction force is applied. Connection is made to rings 5 for the application of the pulling force, which may be supplied by any convenient source. As the extractor pulls on the tube during removal, the tapered surfaces of the sleeve and jaws slip relative to one another, resulting in increasing clamping pressure on the tube proportionately greater than the pulling force required to remove the tube from the soil.

If power equipment is used to supply the pulling force for extracting access tubes from the soil, the tubes can be extracted in one continuous motion. However, if a manual jack is used, the extractor may have to be loosened and reattached at lower positions on the tube as it is pulled from the soil. Access tubes are often held tightly by heavy soils until more than one-third to half of their length is extracted. Thus, the capability to reattach the extractor during tube removal with a manual jack is advantageous. The device of the invention easily extracts access tubes against a resistance of up to 1,400 kg with no damage to the tubes.

After the tube has been pulled out of the soil, the extractor is removed from the tube by unscrewing the collar from the sleeve. In heavy soils, a wrench may be required to loosen the collar because of the high clamping force that results from removing the tube against strong resistance.

This novel device finds application for removing or pulling a variety of cylindrical objects. Certain variations may be made in the above design without altering the concept of the invention. For example, hooks could be substituted for rings 5. It would also be possible to substitute different materials for the fabrication of the device.

The following examples are intended only to further illustrate the invention and are not intended to limit the scope of the invention which is defined by the claims.

EXAMPLE 1

Pulling Potential

An extractor for use in removing neutron access tubes having an outside diameter of about 4.5 cm fabricated of carbon steel according to the following specifications: overall assembled length without lugs 6, 11.4 cm; outside diameter of outer sleeve 1, 8.9 cm; inner surface 2 and jaws 3 were tapered at an angle of 4°. The extractor was evaluated for efficacy by using a fork lift to pull against the extractor positioned on an access tube that had been fastened to a 7.6-cm diameter hydraulic cylinder fitted with a pressure gauge. Tensile force was calculated by the equation, $F=PA$; where $F$=tensile force in kg, $P$=gauge pressure reading in kg/cm$^2$, and $A$=cross-sectional area of the hydraulic cylinder in cm$^2$. Experiments indicated that the extractor held access tubes against more than 1,400 kg of tensile force without damaging the tubes.

EXAMPLE 2

Power Extraction

The extractor of Example 1 was evaluated for efficiency of operation in field experiments by removing 4.5-cm diameter neutron access tubes with a hydraulic lift on a tractor in accordance with procedures described supra. More than 30 access tubes were removed in 1 hour without any noticeable damage to the tubes.

EXAMPLE 3

Manual Extraction

The procedures of Example 2 were repeated except that the access tubes were removed with a manual jack instead of with power equipment. The tubes (210 cm long) had been placed in heavy, clay loam soil near Fort Collins, CO, at a depth of 180 cm. Fourteen tubes per hour were removed without any noticeable damage to the tubes.

It is understood that the foregoing detailed description is given merely by way of illustration and that modification and variations may be made therein without departing from the spirit and scope of the invention.

We claim:

1. An annular device for securely gripping the outer surface of a cylindrical object and pulling said object against a resistant force comprising:

a. an annular sleeve adapted to loosely fit around the cylindrical object, wherein said sleeve has a tapered inner surface and an external means adapted for applying a force substantially parallel to the axis of the cylindrical object;

b. at least two conically tapered jaws, each having along its longitudinal axis a first end adapted to fit between the inner surface of the sleeve and the outer surface of the cylindrical object and a second end adapted to protrude from said sleeve, wherein said second end has both an exterior transverse groove and an interior transverse groove, said exterior groove being intermediate to the interior groove and the first end along said longitudinal axis;

c. an annular collar adapted to fit around the cylindrical object and to fasten to the sleeve by means of mating threads in the collar and the sleeve, and further adapted to engage said exterior groove in each of the jaws; and d. a snap ring adapted to engage said interior groove in each of the jaws and thereby retain the jaws on said collar, wherein said collar and said snap ring collectively serve to secure the jaws within the sleeve so that the jaws frictionally engage both the inner surface of the sleeve and the outer surface of the cylindrical object.

2. The device as described in claim 1 wherein the number of jaws is four.

* * * * *